US010198016B2

(12) United States Patent
Fujimoto

(10) Patent No.: US 10,198,016 B2
(45) Date of Patent: Feb. 5, 2019

(54) LOAD CONTROL APPARATUS FOR PREVENTING CONTACT FAILURE OF RELAY CONTACT

(71) Applicant: FANUC CORPORATION, Yamanashi (JP)

(72) Inventor: Taisei Fujimoto, Yamanashi (JP)

(73) Assignee: FANUC CORPORATION, Yamanashi (JP)

( * ) Notice: Subject to any disclaimer, the term of this patent is extended or adjusted under 35 U.S.C. 154(b) by 53 days.

(21) Appl. No.: 15/333,561

(22) Filed: Oct. 25, 2016

(65) Prior Publication Data

US 2017/0115681 A1 Apr. 27, 2017

(30) Foreign Application Priority Data

Oct. 27, 2015 (JP) ..... 2015-210758

(51) Int. Cl.
*G05F 1/625* (2006.01)
*H01H 47/00* (2006.01)
*H01H 47/22* (2006.01)

(52) U.S. Cl.
CPC ..... *G05F 1/625* (2013.01); *H01H 47/002* (2013.01); *H01H 47/22* (2013.01)

(58) Field of Classification Search
None
See application file for complete search history.

(56) References Cited

U.S. PATENT DOCUMENTS

| | | | | |
|---|---|---|---|---|
| 6,002,559 | A | 12/1999 | Meyer | |
| 7,854,832 | B2 | 12/2010 | Komatsu et al. | |
| 9,117,609 | B2 | 8/2015 | Kodama | |
| 9,184,005 | B2 | 11/2015 | Miura | |
| 9,711,309 | B2 | 7/2017 | McCormick et al. | |
| 2015/0028877 | A1* | 1/2015 | McCormick ..... | H01H 47/002 324/418 |

FOREIGN PATENT DOCUMENTS

| | | | |
|---|---|---|---|
| CN | 101047073 | A | 10/2007 |
| CN | 103443895 | A | 12/2013 |
| CN | 104272421 | A | 1/2015 |

(Continued)

*Primary Examiner* — Thienvu Tran
*Assistant Examiner* — David M Stables
(74) *Attorney, Agent, or Firm* — RatnerPrestia

(57) ABSTRACT

A load control apparatus includes: a relay control unit that outputs an open or close command; a power supply adjustment unit; a contact resistance measurement unit that measures a resistance value of the relay; and an adjustment command generation unit that outputs to the power supply adjustment unit an increase command that causes a current flowing between the contacts of the relay or a voltage applied therebetween to be a value greater than a steady-state value when the resistance value becomes greater than or equal to a predetermined threshold value, and outputs to the power supply adjustment unit a release command that returns the current flowing between the contacts of the relay or the voltage applied therebetween to the steady-state value when, after the increase command is outputted, the resistance value becomes smaller than the predetermined threshold value and the close command is received from the relay control unit.

2 Claims, 4 Drawing Sheets

(56) References Cited

FOREIGN PATENT DOCUMENTS

| | | | |
|---|---|---|---|
| CN | 104350570 | A | 2/2015 |
| JP | H 04-216293 | A | 8/1992 |
| JP | 2000-182495 | A | 6/2000 |
| JP | 2013-105550 | A | 5/2013 |
| JP | 2014120380 | A | 6/2014 |

* cited by examiner

LOAD CONTROL APPARATUS FOR PREVENTING CONTACT FAILURE OF RELAY CONTACT

BACKGROUND OF THE INVENTION

1. Field of the Invention

The present invention relates to a load control apparatus that controls an operation of a load by controlling power supplied to the load by opening and closing of a relay.

2. Description of the Related Art

It has conventionally been the practice that an operation of a load such as pump, light, etc., mounted to a machine tool is controlled by opening and closing of a relay provided between a power supply and the load. FIG. 4 is a view for explaining an operation of general load control apparatus. A relay control unit 111 outputs an open command or a close command to a relay 2 in accordance with a load control command inputted via manipulation by the operator (user) or inputted from an external device (not illustrated) that operates based on a predetermined program. The relay 2 is provided between a power supply 4 and a load 3. A load control apparatus 101 includes the relay control unit 111. The relay 2 operates such that contacts are closed upon receipt of a close command from the relay control unit ill. When the contacts of the relay 2 are closed, a closed circuit including the relay 2, the power supply 4 and the load 3, is constituted so that power is supplied from the power supply 4 to the load 3. Further, the relay 2 operates such that the contacts are opened upon receipt of an open command from the relay control unit 111. When the contacts of the relay 2 are opened, power is no longer supplied from the power supply 4 to the load 3. Thus, the operation of the load 3 is controlled so that power supplied from the power supply 4 to the load 3 is adjusted by controlling the opening and closing operation of the relay 2 by the load control apparatus 101.

When oxide (silicon oxide) or carbide accumulates on the contacts of the relay, a failure such as contact failure (conduction failure) occurs.

For example, as described in Japanese Unexamined Patent Publication No. H4-216293, there is a method in which a relay operation detection circuit is provided for contacts of a relay, and a contact failure of the relay is detected by the relay operation detection circuit without operating a load.

Further, as described in Japanese Unexamined Patent Publication No. 2013-105550, there is a method in which as a measure for preventing a failure due to accumulation of oxide or carbide on contacts of a relay, the oxide or carbide accumulated on the contacts is cleaned off by an arc discharge generated during opening and closing of the relay by increasing a current flowing between the contacts of the relay or a voltage applied therebetween.

Further, for example, as described in Japanese Unexamined Patent Publication No. 2000-182495, as a cleaning method which does not use an arc discharge, there is a method in which when a contact failure is detected or when it is desired to clean contacts, the contacts are forcibly opened and closed and the contacts are cleaned by vibration or expulsion action due to the opening and closing operation.

As described above, a failure such as contact failure (conduction failure) caused by accumulation of oxide or carbide on the contacts of the relay causes a decrease in the rate of operation of the load control apparatus. Particularly, with a machine tool including a relay, there is a possibility that occurrence of such failure not only causes a decrease in the rate of operation but also leads to occurrence of a serious accident. Therefore, it is important to detect a relay failure.

According to the method described in Japanese Unexamined Patent Publication No. H4-216293, it is possible to detect a contact failure of the relay so that a serious accident may not occur due to a contact failure, but it is not possible to prevent a contact failure. Since oxide, carbide, etc., gradually accumulates on the contacts of the relay as time elapses, a contact failure of the relay is an unavoidable problem.

Further, according to the method described in Japanese Unexamined Patent Publication No. 2013-105550, oxide or carbide accumulated on the contact of the relay is cleaned off by an arc discharge, so that it is possible to prevent a contact failure due to accumulation of oxide or carbide. However, the arc discharge itself is a phenomenon that tends to damage the contact of the relay, and therefore, after all, occurrence of a failure such as decrease in life span and fusion of the contacts of the relay is unavoidable. Particularly, an arc discharge that occurs when the contacts of the relay are opened is larger in discharge energy and longer in duration than that which occurs when the contacts of the relay are closed, and therefore constitutes a major cause for the decrease in life span and fusion of the contacts.

Further, the method described in Japanese Unexamined Patent Publication No. 2000-182495 is for removing a deposit such as oxide or carbide by vibration due to the forced opening and closing operation of the contact of the relay without using an arc discharge. However, since the vibration due to the forced opening and closing operation of the contacts of the relay is small, elimination effect cannot be expected when the deposit to be eliminated or the contact itself are light-weight.

SUMMARY OF INVENTION

In view of the problems as described above, it is an object the invention to provide a load control apparatus capable of preventing a contact failure of a relay used to control the operation of a load.

In order to achieve the above-described object, the load control apparatus that controls power for operating a load by opening and closing of a relay includes: a relay control unit that outputs an open command that commands contacts of the relay to be opened and a close command that the contacts of the relay to close; a power supply adjustment unit that adjusts, based on an adjustment command received, a current flowing between the contacts of the relay or a voltage applied therebetween when the contacts of the relay are closed to supply power to the load; a contact resistance measurement unit that measures a resistance value of a contact resistance of the relay; and an adjustment command generation unit that outputs to the power supply adjustment unit an increase command which is an adjustment command that causes a current flowing between the contacts of the relay or a voltage applied therebetween to be at a value greater than a steady-state value when the resistance value measured by the contact resistance measurement unit becomes greater than or equal to a predetermined threshold value, and outputs to the power supply adjustment unit a release command which is an adjustment command that returns the current flowing between the contacts of the relay or the voltage applied therebetween to the steady-state value when, after the increase command is outputted, the resistance value measured by the contact resistance measurement unit becomes smaller than the predetermined threshold value and the close command is received from the relay control unit.

Further, the adjustment command generation unit may be configured to output the increase command to the power supply adjustment unit when the resistance value measured by the contact resistance measurement unit becomes greater than or equal to the predetermined threshold value and the open command is received from the relay control unit.

BRIEF DESCRIPTION OF THE DRAWINGS

The invention will be understood more clearly by referring to the following accompanying drawings.

DETAILED DESCRIPTION

A load control apparatus that prevents a contact failure of contacts of a relay will be described below with reference to the drawings. It should be understood that the present invention is not limited to the drawings or embodiments described below.

Figure 1:
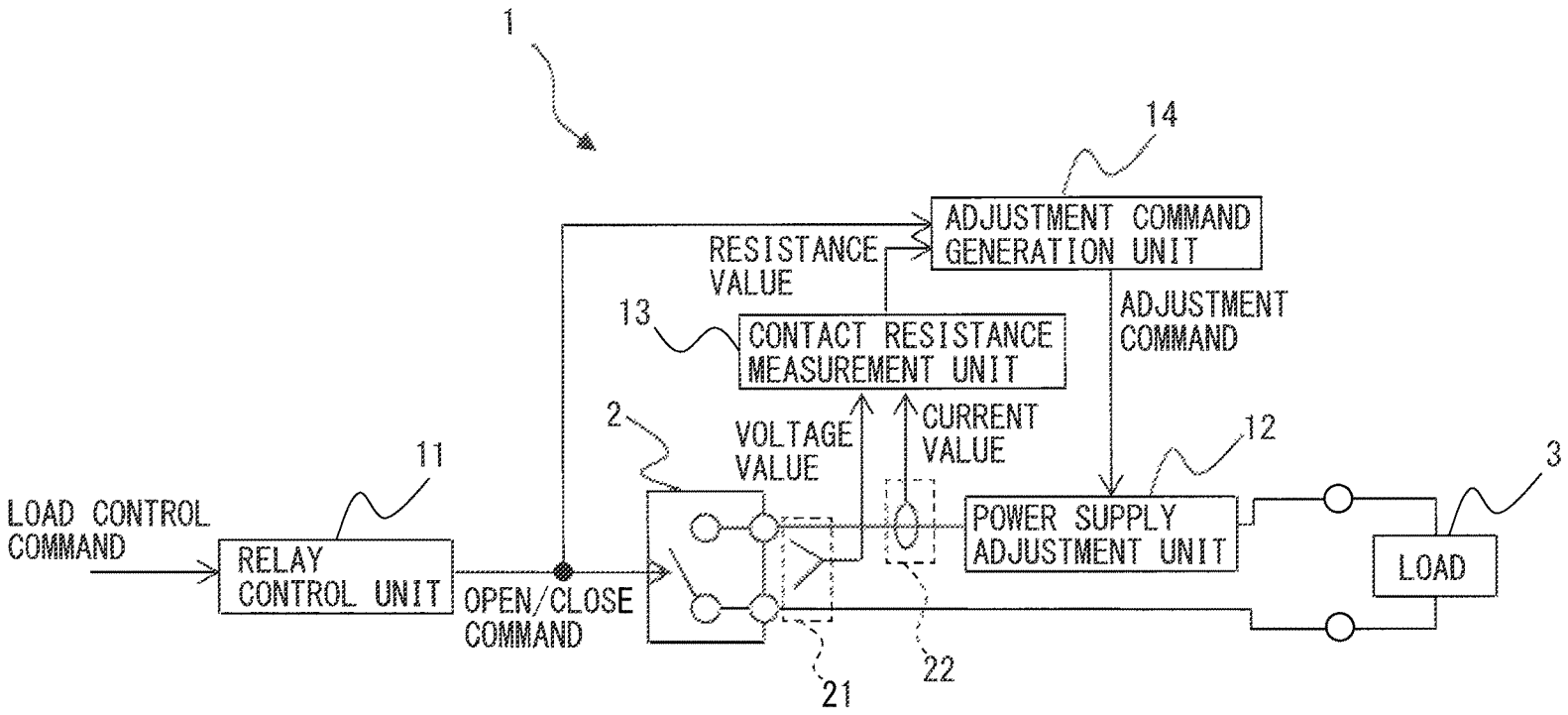
FIG. 1 is a block diagram illustrating a load control apparatus according to an embodiment.

FIG. 1 is a block diagram illustrating the load control apparatus according to the embodiment. Description will be made herein of the load control apparatus 1 that controls power to operate a load 3 by opening and closing of a relay 2. The type of the load 3 does not particularly limit the present invention, and includes, for example, a pump, a light, etc., mounted to a machine tool. Further, the structure per se of the relay 2 also does not particularly limit the present invention. In the present invention, when a predetermined condition is satisfied, a current flowing between the contacts of the relay 2 or a voltage applied therebetween is changed to a value greater than that in a steady state, and then oxide or carbide accumulated on the contacts of the relay 2 is cleaned off by an arc discharge generated during opening and closing of the relay 2.

The load control apparatus 1 according to the embodiment includes a relay control unit 11, a power supply adjustment unit 12, a contact resistance measurement unit 13, and an adjustment command generation unit 14.

The relay control unit 11 outputs an open command that commands the contacts of the relay 2 to be opened and a close command that commands the contacts of the relay 2 to close, in response to a load control command inputted from an external device (not illustrated) that operates based on a load control command or a predetermined program inputted via manipulation by the operator (user). For example, in the case of a machine tool, the relay control unit 11 is provided in an arithmetic processing unit possessed by a numerical control apparatus (CNC) or configured to be a relay-dedicated microcomputer. The opening and closing operation of the relay 2 is controlled in accordance with the open command and close command outputted from the relay control unit 11.

The power supply adjustment unit 12 adjusts, in accordance with an adjustment command, a current flowing between the contacts of the relay 2 or a voltage applied therebetween when the contacts of the relay 2 are closed to supply power to the load 3. It is either one of the current flowing between the contacts of the relay 2 and the voltage applied between the contacts of the relay 2 that is adjusted in accordance with the adjustment command received. Although described in detail hereinbelow, the adjustment command is generated by the adjustment command generation unit 14 and includes an increase command that causes the current flowing between the contacts of the relay 2 or the voltage applied therebetween to be a value greater than a steady-state value and a release command that returns the increased current flowing between the contacts of the relay 2 or the increased voltage applied therebetween to the steady-state value. The power supply adjustment unit 12 may, for example, be one which can change, in accordance with the adjustment command received, the current flowing between the contacts of the relay 2 or the voltage applied therebetween, and is configured, including, for example, a variable resistor, a voltage-variable regulator, a DC chopper circuit, a PWM rectifier, etc., to be a combination of either of these with a DC power supply or an AC power supply.

The contact resistance measurement unit 13 measures a resistance value of a contact resistance of the relay 2. The contact resistance is a composite resistance of a boundary resistance and constriction resistance at an interface between the contacts and a conductor resistivity of a movable piece, a terminal, a contact, etc., which constitutes a circuit. A resistance value of the contact resistance is obtained by dividing a value of the voltage applied between the contacts of the relay 2, which is detected by a voltage detection unit 21, by a value of the current flowing between the contacts of the relay 2, which is detected by a current detection unit 22, when the contacts of the relay 2 are closed. The resistance value measured by the contact resistance measurement unit 13 is sent to the adjustment command generation unit 14.

The adjustment command generation unit 14 outputs to the power supply adjustment unit 12 the increase command which is the adjustment command that causes the current flowing between the contacts of the relay 2 or the voltage applied therebetween to be a value greater than the steady-state value, when the resistance value of the contact resistance measured by the contact resistance measurement unit 13 becomes greater than or equal to a predetermined threshold value. Further, after the increase command has been outputted, the adjustment command generation unit 14 outputs to the power supply adjustment unit 12 a release command which is an adjustment command that returns the current flowing between the contacts of the relay 2 or the voltage applied therebetween to the steady-state value when the resistance value of the contact resistance measured by the contact resistance measurement unit 13 becomes smaller than the predetermined threshold value and the close command is received from the relay control unit 11. For example, in the case of a machine tool, the adjustment command generation unit 14 is provided in an arithmetic processing unit possessed by a numerical control apparatus (CNC) or configured to be a relay-dedicated microcomputer.

The steady-state value of the current flowing between the contacts of the relay 2 or the voltage applied therebetween may be set to a value such that the life of the relay 2 is not reduced due to an arc discharge generated during contact opening and closing. Further, the value of the current flowing between the contacts of the relay 2 or the voltage applied therebetween which becomes greater than the steady-state value as a result of the increase command may be set to a value such that the specification of the load 3 is not exceeded. Any one of the values can be achieved by an adjustment process in the power supply adjustment unit 12.

Further, generally, the more increased is the amount of oxide or carbide accumulated on the contacts of the relay 2, the greater the resistance value of the contact resistance; thus, the above "predetermined threshold value" which constitutes a criterion for determination of the resistance value of the contact resistance at the adjustment command generation unit 14 may be set to a value somewhat smaller than a resistance value for when a contact failure occurs due to the accumulation of oxide or carbide.

Figure 2:
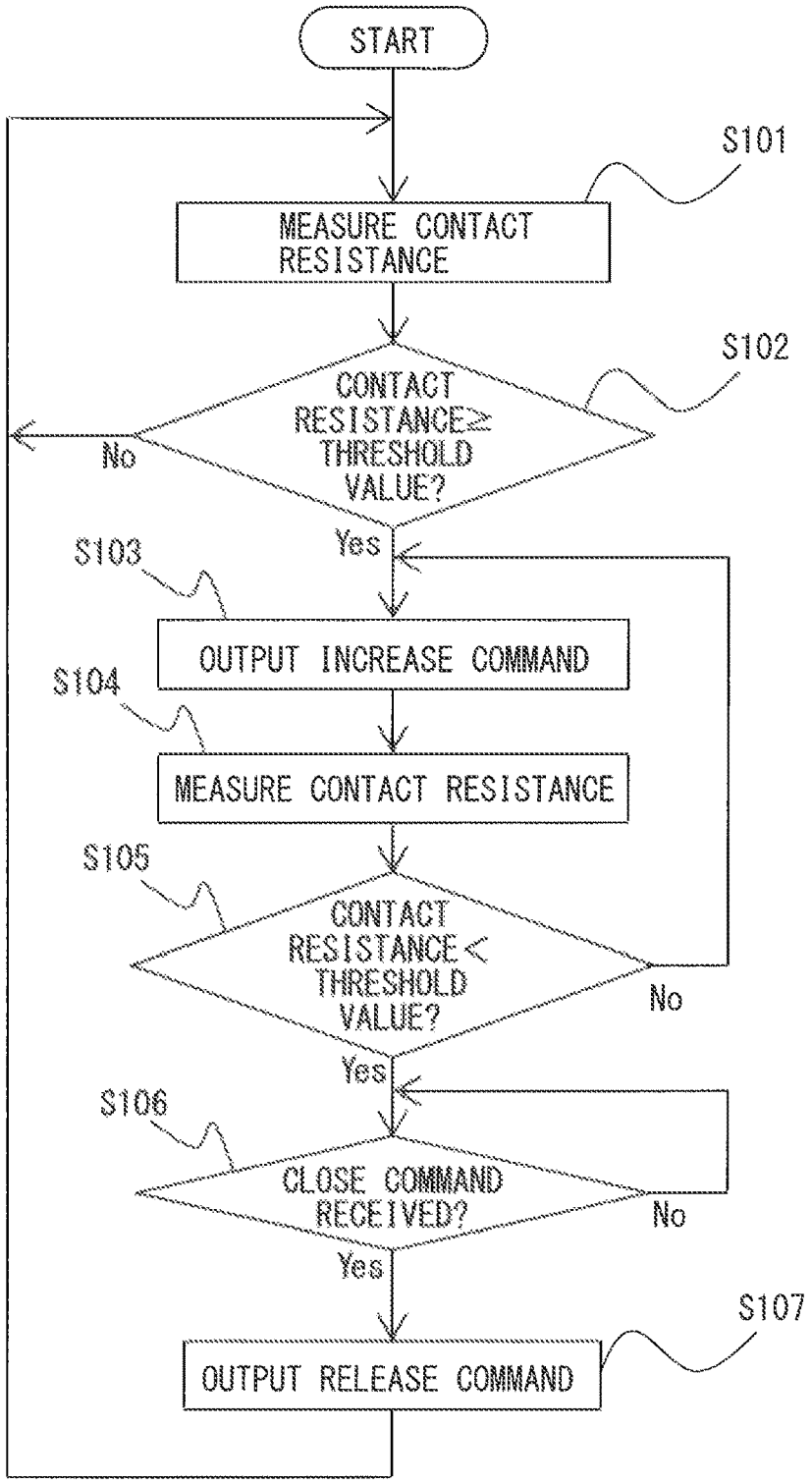
FIG. 2 is a flow chart illustrating an operation flow of the load control apparatus according to the embodiment.

FIG. 2 is a flow chart illustrating an operation flow of the load control apparatus according to the embodiment. As described above, it is the current or voltage flowing between the contacts of the relay 2 that the power supply adjustment unit 12 changes (adjusts) upon receipt of the adjustment command, but in the flow chart below, for simplicity of description, a case will be described in which an adjustment is made to the current.

The relay control unit 11 outputs an open command that commands the contacts of the relay 2 to be opened and a close command that commands the contacts of the relay 2 to close, in response to a load control command inputted from an external device that operates based on a load control command or a predetermined program inputted via manipulation by the operator (user). In this manner, the opening and closing operation of the relay 2 is controlled. In the meantime, at step S101, a measurement is made of a resistance value of the contact resistance of the relay 2 when the contacts of the relay 2 are closed. The resistance value measured by the contact resistance measurement unit 13 is sent to the adjustment command generation unit 14.

As oxide or carbide is accumulated on the contacts of the relay 2, the resistance value of the contact resistance of the relay 2 gradually becomes large. At step S102, the adjustment command generation unit 14 determines whether the resistance value of the contact resistance measured by the contact resistance measurement unit 13 at step S101 becomes greater than or equal to a predetermined threshold value. When it is determined at step S102 that the resistance value of the contact resistance is smaller than the predetermined threshold value, the process returns to step S101, and there are further performed the opening and closing operation of the relay 2 based on the open command or the close command generated by the relay control unit 11 and the measurement of the resistance value of the contact resistance of the relay 2 when the contacts of the relay 2 are closed. In contrast, when it is determined at step S102 that the resistance value of the contact resistance becomes greater than or equal to the predetermined threshold value, the process proceeds to step S103.

At step S103, the adjustment command generation unit 14 outputs to the power supply adjustment unit 12 an increase command that causes the current flowing between the contacts of the relay 2 when the contacts of the relay 2 are closed to be a value greater than the steady-state value. In response thereto, the power supply adjustment unit 12 changes its current output setting such that the value of the current flowing between the contacts of the relay 2 when the contacts of the relay 2 are closed becomes a value greater than the steady-state value. For example, when the power supply adjustment unit 12 is configured of a combination of a variable resistor and a power supply, the power supply adjustment unit 12 changes the resistance value of the variable resistor when the increase command is received to a value smaller than the resistance value during the steady state. Further, for example, when the power supply adjustment unit 12 is configured of a combination of a voltage variable regulator, a DC chopper circuit or PWM rectifier and a power supply, the power supply adjustment unit 12 performs switching operation of the voltage variable regulator, the DC chopper circuit or the PWM rectifier such that the value of a current outputted via the voltage variable regulator, the DC chopper circuit or the PWM rectifier becomes greater than the value of the current during the steady state. Incidentally, although description has been made herein of the case in which the current is adjusted, a case in which the voltage is adjusted is also possible in a similar manner.

Even after the process of step S103 is performed, the relay 2 performs opening and closing operation when the open command or the close command is outputted from the relay control unit 11, but when the contacts of the relay 2 are closed, the value of the current flowing between the contacts of the relay 2 becomes a value greater than the steady-state value. After the process of step S103 is performed, an arc discharge will be generated during the opening and closing operation of the relay 2 under such a condition. Particularly, when the contacts of the relay 2 are closed, the effect of eliminating oxide or carbide is high since the value of the current flowing between the contacts of the relay 2 is greater than the steady-state value. However, since an arc discharge generated when the contacts of the relay 2 are closed is small in discharge energy and short in duration as compared with an arc discharge generated when the contacts of the relay 2 are opened, there is no such possibility that the contact life is shortened and/or the contacts are fused together as in the prior art even if a current greater than the steady-state flows when the contacts of the relay 2 are closed.

Due to the arc discharge generated during opening and closing (particularly during closing) of the relay 2, oxide or carbide accumulated on the contacts of the relay 2 is cleaned off, and the resistance value of the contact resistance of the relay 2 is gradually decreased. At step S104, the resistance value of the contact resistance of the relay 2 when the contacts of the relay 2 are closed is measured. The resistance value measured by the contact resistance measurement unit 13 is sent to the adjustment command generation unit 14.

At step S105, the adjustment command generation unit 14 determines whether the resistance value of the contact resistance measured by the contact resistance measurement unit 13 at step S104 becomes a value smaller than the predetermined threshold value. When it is determined at step S105 that the resistance value of the contact resistance is greater than or equal to the predetermined threshold value, the process returns to step S103, and there are further performed the opening and closing operation of the relay 2 based on the open command or the close command generated by the relay control unit 11 and the measurement of the resistance value of the contact resistance of the relay 2 when the contacts of the relay 2 are closed. In contrast, when it is determined at step S105 that the resistance value of the contact resistance becomes smaller than the predetermined threshold value, the process proceeds to step S106.

At step S106, the adjustment command generation unit 14 determines whether the close command is received from the relay control unit 11. When it is determined at step S106 that the close command is received from the relay control unit 11, the process proceeds to step S107.

At step S107, the adjustment command generation unit 14 outputs to the power supply adjustment unit 12 a release command that returns the current flowing between the contacts of the relay 2 to the steady-state value. In this manner, the power supply adjustment unit 12 changes its current output setting such that when a current flows between the contacts of the relay 2 when the contacts of the relay 2 are closed, the value of the current returns to the steady-state value. For example, when the power supply adjustment unit 12 is configured of a combination of a variable resistor and a power supply, the power supply adjustment unit 12 returns the resistance value of the variable resistor when the release command is received to the resistance value during the steady state. Further, for example, when the power supply adjustment unit 12 is configured of a combination of a voltage variable regulator, a DC chopper circuit or PWM rectifier and a power supply, the power supply adjustment unit 12 performs switching operation of the voltage variable regulator, the DC chopper circuit or the PWM rectifier such that the value of a current outputted via the voltage variable regulator, the DC chopper circuit or the PWM rectifier becomes the value of the current during the steady state. Incidentally, although description has been made herein of the case in which the current is adjusted, a case in which the voltage is adjusted is also possible in a similar manner. After the process of step S107 is performed, the process returns to step S101, and even thereafter, the relay 2 performs opening and closing operation when the open command or the close command is outputted from the relay control unit 11, wherein when the contacts of the relay 2 are closed, the value of the current flowing between the contacts of the relay 2 is back to the steady-state value. As described, the steady-state value of the current flowing between the contacts of the relay 2 is set to a value to such an extent that the life of the relay 2 is not shortened due to the arc discharge generated during contact opening and closing; thus, there is no such possibility that the contact life is shortened and/or the contacts are fused together as in the prior art.

Figure 3:
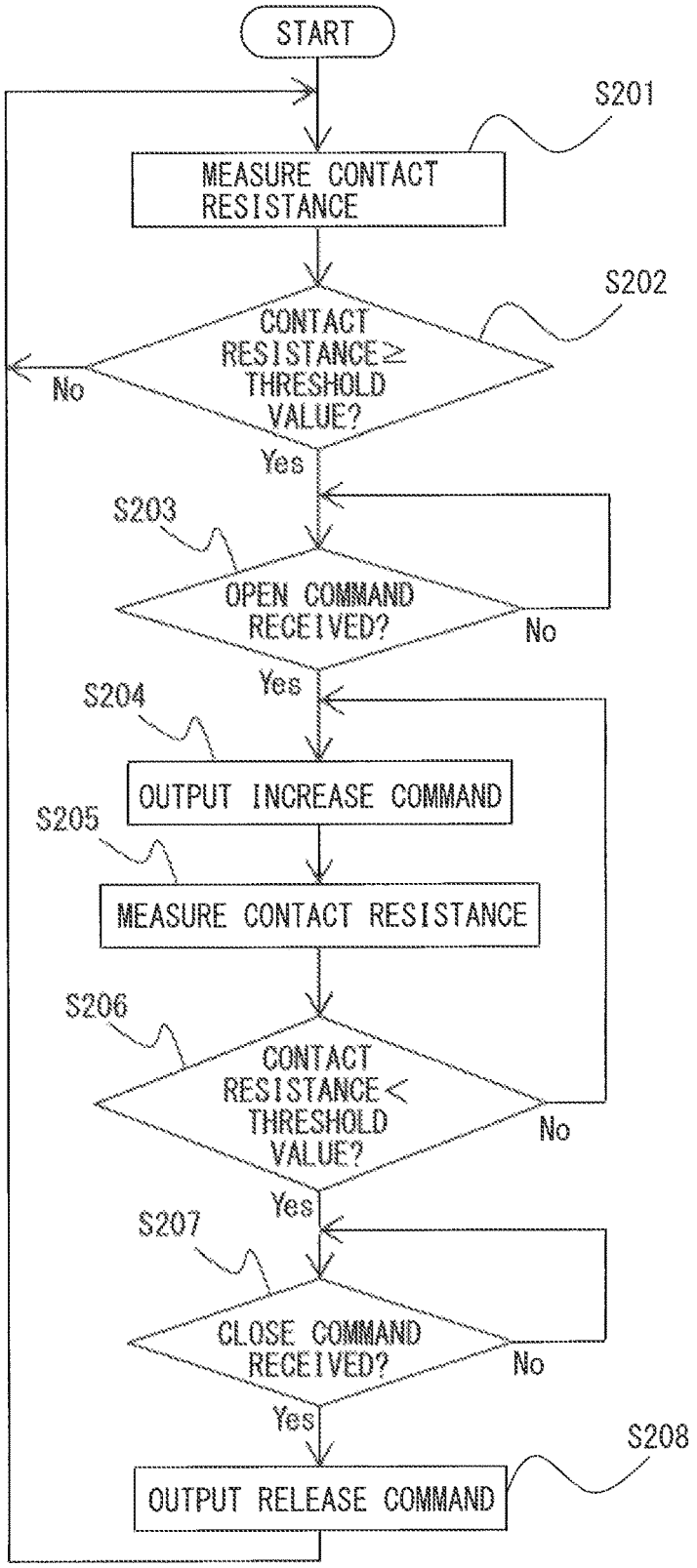
FIG. 3 is a flow chart illustrating an operation flow of a load control apparatus according to a modified example of the embodiment.
Figure 4:
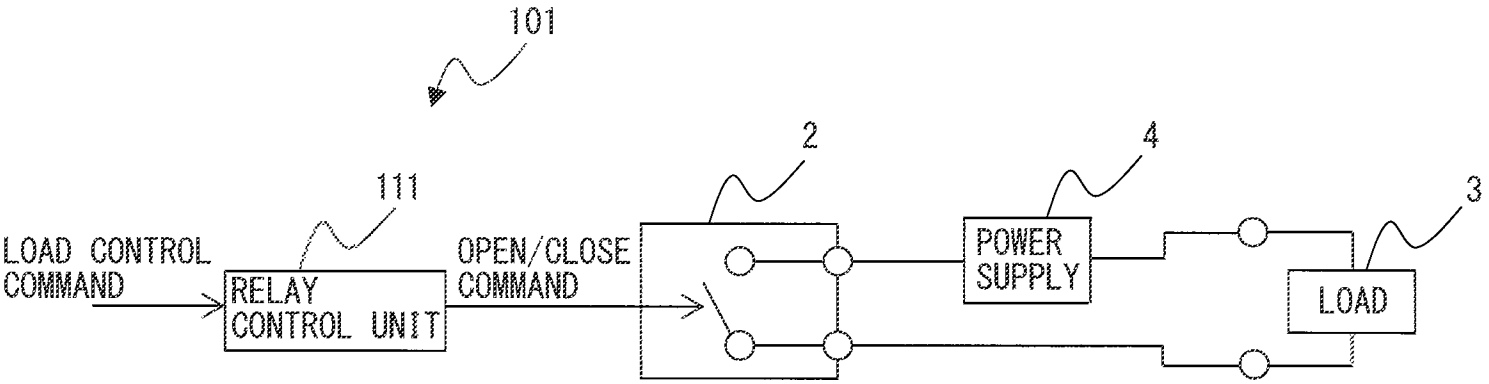
FIG. 4 is a view for explaining an operation of a general load control apparatus.

FIG. 3 is a flow chart illustrating an operation flow of a load control apparatus according to a modified example of the embodiment. In the present modified example, there is changed the condition for which the adjustment command generation unit 14 in the embodiment described with reference to FIGS. 1 and 2 outputs the increase command.

As in the above-described embodiment, the relay control unit 11 outputs an open command that commands the contacts of the relay 2 to be opened and a close command that commands the contacts of the relay 2 to close, in response to a load control command inputted from an external device that operates based on a load control command or a predetermined program inputted via manipulation by the operator (user). In this manner, the opening and closing operation of the relay 2 is controlled. In the meantime, at step S201, a measurement is made of a resistance value of the contact resistance of the relay 2 when the contacts of the relay 2 are closed, as is the case with step S101 in the above-described embodiment. The resistance value measured by the contact resistance measurement unit 13 is sent to the adjustment command generation unit 14.

At step S202, a process similar to step S102 in the above-described embodiment is performed. In other words, at step S202, the adjustment command generation unit 14 determines whether the resistance value of the contact resistance measured by the contact resistance measurement unit 13 at step S201 becomes greater than or equal to a predetermined threshold value. When it is determined at step S202 that the resistance value of the contact resistance is smaller than the predetermined threshold value, the process returns to step S201, and there are further performed the opening and closing operation of the relay 2 based on the open command or the close command generated by the relay control unit 11 and the measurement of the resistance value of the contact resistance of the relay 2 when the contacts of the relay 2 are closed. In contrast, when it is determined at step S202 that the resistance value of the contact resistance becomes greater than or equal to the predetermined threshold value, the process proceeds to step S203.

At step S203, the adjustment command generation unit 14 determines whether an open command is received from the relay control unit 11. When it is determined at step S203 that the open command is received from the relay control unit 11, the process proceeds to step S204, and then the contacts of the relay 2 are opened by the open command outputted from the relay control unit 11.

At step S204, a process similar to step S103 in the above-described embodiment is performed. In other words, at step S204, the adjustment command generation unit 14 outputs to the power supply adjustment unit 12 an increase command that causes the current flowing between the contacts of the relay 2 when the contacts of the relay 2 are closed to be a value greater than the steady-state value. In response thereto, the power supply adjustment unit 12 changes its current output setting such that the value of the current flowing between the contacts of the relay 2 when the contacts of the relay 2 are closed becomes a value greater than the steady-state value.

In this manner, in the present modified example, after the determination processes of steps S202 and S203 are gone through, the adjustment command generation unit 14 outputs an increase command to the power supply adjustment unit 12 at step S204. It is for the following reason that unlike the embodiment described with reference to FIG. 2, the condition that the adjustment command generation unit 14 outputs the increase command is set to be "when the adjustment command generation unit 14 receives an open command from the relay control unit 11 (step S203) after the resistance value of the contact resistance measured by the contact resistance measurement unit 13 becomes greater than or equal to the predetermined threshold value (step S202)".

In other words, the reason is this: since an arc discharge generated when the contacts of the relay 2 are opened has a large discharge energy and a long duration time as compared with an arc discharge generated when the contacts of the relay 2 are closed, it is configured such that the adjustment command generation unit 14 outputs an increase command to the power supply adjustment unit 12 after the contacts of the relay 2 are opened by the open command outputted from the relay control unit 11, so that the arc discharge generated when the contacts of the relay 2 are opened which has a large discharge energy and a long duration time is avoided at least once, thereby minimizing the possibility that the contact life is shortened and/or the contacts are fused together.

Even after the process of step S204 is performed, the relay 2 performs opening and closing operation when the open command or the close command is outputted from the relay control unit 11, and thus, after the process of step S204 is performed, an arc discharge will, during the opening and closing operation of the relay 2, be generated for a value of the current flowing between the contacts of the relay 2 which is greater than the steady-state value when the contacts of the relay 2 are closed, thereby resulting in elimination of a deposit in a manner similar to that after process of step S103 in the embodiment described with reference to FIG. 2 is performed.

At step S205, a process similar to that of step S104 in the above-described embodiment is performed. In other words, at step S205, a measurement is made of the resistance value of the contact resistance of the relay 2 when the contacts of the relay 2 are closed. The resistance value measured by the contact resistance measurement unit 13 is sent to the adjustment command generation unit 14.

At step S206, a process similar to that of step S105 in the above-described embodiment is performed. In other words, at step S206, the adjustment command generation unit 14 determines whether the resistance value of the contact resistance measured by the contact resistance measurement unit 13 at step S205 becomes smaller than a predetermined threshold value. When it is determined at step S206 that the resistance value of the contact resistance is greater than or equal to the predetermined threshold value, the process returns to step S204, and there are further performed the opening and closing operation of the relay 2 based on the open command or the close command generated by the relay control unit 11 and the measurement of the resistance value of the contact resistance of the relay 2 when the contacts of the relay 2 are closed. In contrast, when it is determined at step S206 that the resistance value of the contact resistance becomes smaller than the predetermined threshold value, the process proceeds to step S207.

At step S207, a process similar to that of step S106 in the above-described embodiment is performed. In other words, at step S207, the adjustment command generation unit 14 determines whether a close command is received from the relay control unit 11. When it is determined at step S207 that the close command is received from the relay control unit 11, the process proceeds to step S208.

At step S208, a process similar to that of step S107 in the above-described embodiment. In other words, at step S208, the adjustment command generation unit 14 outputs to the power supply adjustment unit 12 a release command that returns the current flowing between the contacts of the relay 2 to the steady-state value. In this manner, the power supply adjustment unit 12 changes its current output setting such that when a current flows between the contacts of the relay 2 when the contacts of the relay 2 are closed, the value of the current returns to the steady-state value. After the process of step S208 is performed, the process returns to step S201, and the relay 2 performs opening and closing operation when the open command or the close command is outputted from the relay control unit 11, wherein when the contacts of the relay 2 are closed, the value of the current flowing between the contacts of the relay 2 is back to the steady-state value. As described, the steady-state value of the current flowing between the contacts of the relay 2 is set to a value to such an extent that the life of the relay 2 is not shortened due to the arc discharge generated during contact opening and closing; thus, there is no such possibility that the contact life is shortened and/or the contacts are fused together as in the prior art.

According to the present invention, it is possible to achieve a load control apparatus capable of preventing a contact failure of a relay used to control the operation of a load.

According to the present invention, when a predetermined condition is satisfied, a current flowing between contacts of a relay or a voltage applied therebetween is changed to a value greater than that in a steady state, and then oxide or carbide accumulated on the contacts of the relay is cleaned off by an arc discharge generated during opening and closing of the relay, thereby preventing a contact failure of the relay. Particularly, when the contacts of the relay are closed, the effect of eliminating oxide or carbide is high since the value of the current flowing between the contacts of the relay is greater than the steady-state value. However, since an arc discharge generated when the contacts of the relay are closed is small in discharge energy and short in duration as compared with an arc discharge generated when the contacts of the relay 2 are opened, there is no such possibility that the contact life is shortened and/or the contacts are fused together as in the prior art even if a current greater than the steady-state flows when the contacts of the relay are closed as the present invention.

What is claimed is:

1. A load control apparatus that controls power for operating a load by opening and closing of a relay, comprising:

a relay control unit that outputs an open command that commands contacts of the relay to be opened and a close command that commands the contacts of the relay to close to supply power to the load;

a power supply adjustment unit that adjusts, in response to an adjustment command received, a current flowing between the contacts of the relay or a voltage applied between the contacts of the relay when the contacts of the relay are closed to supply power to the load;

a contact resistance measurement unit that measures a resistance value of a contact resistance of the relay; and an adjustment command generation unit that:

in response to the resistance value measured by the contact resistance measurement unit becoming greater than or equal to a predetermined threshold value, outputs to the power supply adjustment unit an increase command which is an adjustment command that causes a current flowing between the contacts of the relay or a voltage applied between the contacts of the relay to increase to a current value or voltage value greater than a steady-state current value or voltage value, and in response to the resistance value measured by the contact resistance measurement unit becoming smaller than the predetermined threshold value and the close command being received from the relay control unit, outputs to the power supply adjustment unit a release command which is an adjustment command that returns decreases the current flowing between the contacts of the relay or the voltage applied between the contacts of the relay to the steady-state current value or voltage value.

2. The load control apparatus according to claim 1, wherein the adjustment command generation unit outputs the increase command to the power supply adjustment unit when the resistance value measured by the contact resistance measurement unit becomes greater than or equal to the predetermined threshold value and the open command is received from the relay control unit.

* * * * *